US006912980B2

(12) United States Patent
Reif

(10) Patent No.: US 6,912,980 B2
(45) Date of Patent: Jul. 5, 2005

(54) ELECTROMAGNETIC VALVE GEAR

(75) Inventor: Konrad Reif, Ottobrunn (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 10/181,563

(22) PCT Filed: Oct. 5, 2001

(86) PCT No.: PCT/EP01/11479

§ 371 (c)(1),
(2), (4) Date: Jul. 18, 2002

(87) PCT Pub. No.: WO02/066797

PCT Pub. Date: Aug. 29, 2002

(65) Prior Publication Data

US 2003/0131810 A1 Jul. 17, 2003

(30) Foreign Application Priority Data

Feb. 17, 2001 (DE) ..... 101 07 595

(51) Int. Cl.[7] ..... F01L 9/04
(52) U.S. Cl. ..... 123/90.11; 251/129.01
(58) Field of Search ..... 123/90.11; 251/129.01, 251/129.04, 129.05

(56) References Cited

U.S. PATENT DOCUMENTS 5,482,019 A * 1/1996 Ausiello et al. ..... 123/361
5,988,846 A * 11/1999 Flamm et al. ..... 700/8
6,474,276 B1 * 11/2002 Schmitz et al. ..... 123/90.11

FOREIGN PATENT DOCUMENTS

EP 0412578 2/1991
JP 2000130122 5/2000
JP 2000130122 A * 5/2000 ..... F01L/3/24
WO 00/71861 11/2000

* cited by examiner

*Primary Examiner*—Thomas Denion
*Assistant Examiner*—Zelalem Eshete
(74) *Attorney, Agent, or Firm*—Crowell & Moring LLP

(57) ABSTRACT

An electromagnetic valve drive of a charge cycle valve for an internal-combustion engine has an electromagnetic actuator and additional electric devices, such as a power system operating the actuator, a controlling and regulating device as well as a power supply. For reducing electromagnetic compatibility problems and connection problems, at least one information signal connection between two of the devices is established using a glass fiber connection.

7 Claims, 2 Drawing Sheets

ELECTROMAGNETIC VALVE GEAR

BACKGROUND AND SUMMARY OF THE INVENTION

The invention relates to an electromagnetic valve drive of a charge cycle valve for an internal-combustion engine having an electromagnetic actuator and additional electric devices, such as a power part operating the actuator, a controlling and regulating device as well as a power supply.

In the case of such valve drives, usually an armature, which is indirectly or directly coupled with a gas outlet valve, is moved back and forth by the action upon coils. For acting upon the coils, a power supply is required which provides the required energy. Furthermore, the coils themselves are triggered by means of a power part which, in turn, is controlled by a controlling and regulating device. Often, a sensor is also arranged in the actuator, on the basis of whose signal the armature or valve position can be determined indirectly and directly. According to the construction, the sensor and the actuator, the controlling and regulating part as well as the electronic power system or other elements of the electromagnetic valve drive are combined and integrally constructed with one another.

Conventionally, all information signal connections between the individual valve drive elements, thus, for example, between the sensor and the valve control or the engine control, etc., are implemented by electric cables. However, this results in problems concerning electromagnetic stray radiation, as well as plug connection problems and insulation problems.

It is an object of the present invention to avoid these problems with respect to the electromagnetic valve drive.

This object is achieved by of a charge cycle valve for an internal-combustion engine having an electromagnetic actuator and additional electric devices, such as a power part operating the actuator, a controlling and regulating device as well as a power supply. At least one information signal connection is established between two devices using a glass fiber connection.

Accordingly, at least one information signal connection is established between two devices of an electromagnetic valve drive through the use of a glass fiber connection, such as an optical fiber or fiber optic cable. A glass fiber connection is not susceptible to electromagnetic compatibility problems. Furthermore, such glass fiber lines also do not have to be electrically insulated. Also, otherwise existing contact difficulties are to be solved by corresponding connectors.

According to the embodiment, for example, the connections between a valve sensor or actuator sensor, on the one hand, and the controlling and regulating device, on the other hand, between an engine control and the controlling and regulating device, or between the electronic power system and the controlling and regulating device can be established by means of glass fiber connections. It is important in this context that the connection is used only as an information signal transmission. By contrast, an energy supply line is not replaced by means of an optical fiber. According to a particularly preferred embodiment, the different connections can also be partially constructed with glass fiber connections. Thus, for example, a path section which has special electromagnetic compatibility problems can be protected by means of a glass connection.

In the following, the present invention will be explained by means of different embodiments and with reference to the attached drawings.

DETAILED DESCRIPTION OF THE DRAWINGS

In the case of the embodiments illustrated here, one power supply 10 as well as one engine control unit 18, respectively, is provided.

Figure 1:
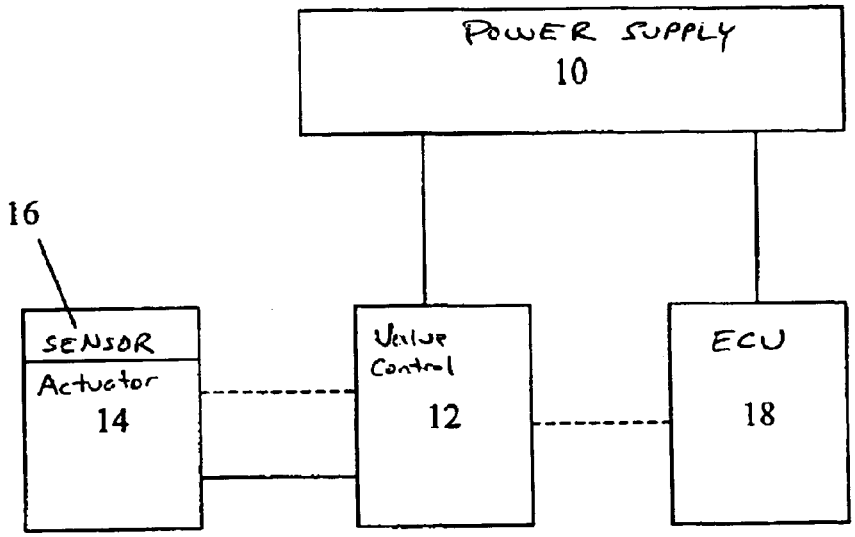
FIG. 1 is a block diagram of a first embodiment of the present invention.

In the embodiment according to FIG. 1, a valve control is indicated which, on the one hand, is connected with the power supply as well as with an actuator 14. These connections are conventionally constructed by means of electric cables. In contrast, the connection between a sensor 16 coupled with the actuator 14 and the valve control 12 is constructed using glass fibers. The connection between the valve control 12 and the engine control 18 is also constructed by means of a glass fiber connection (illustrated in dashed lines).

Figure 2:
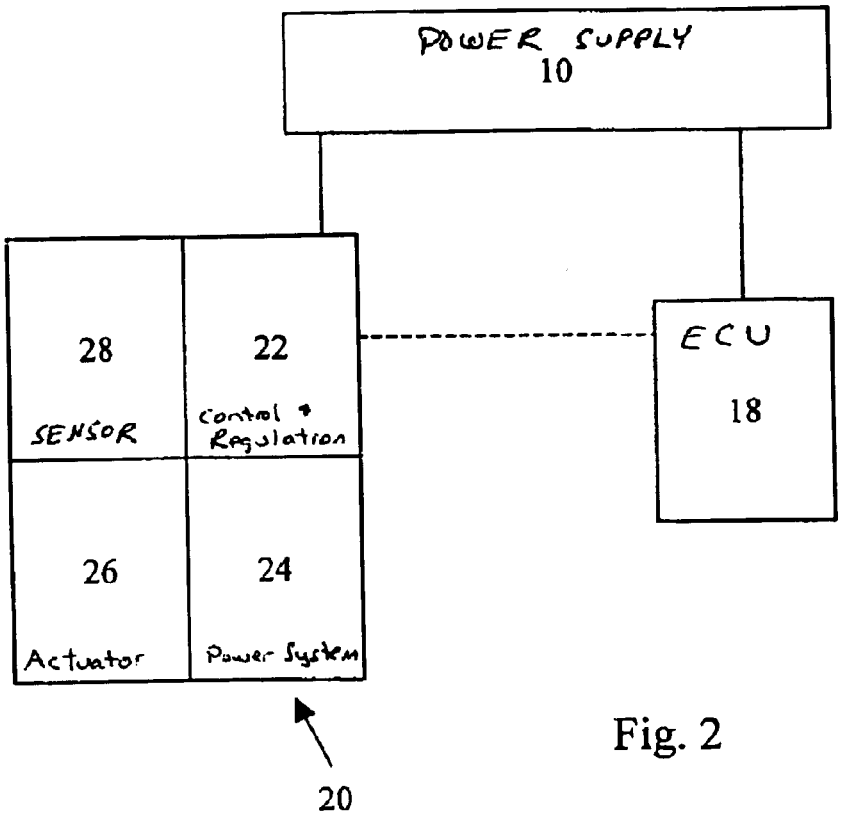
FIG. 2 is a block diagram of a second embodiment of the present invention.

In the embodiment according to FIG. 2, the devices of the electromagnetic valve drive 20, specifically the actuator 26, the electronic power system 24, the electronic controlling and regulating system 22 and the sensor 28, are combined in an integral unit. The corresponding mutual connections are provided in the integral unit itself. For this reason, it is, in the case of this embodiment, only necessary to provide an electric cable connection to the power supply 10, as well as a glass fiber connection between the electronic controlling and regulating system 22 and the engine control 18.

Figure 3:
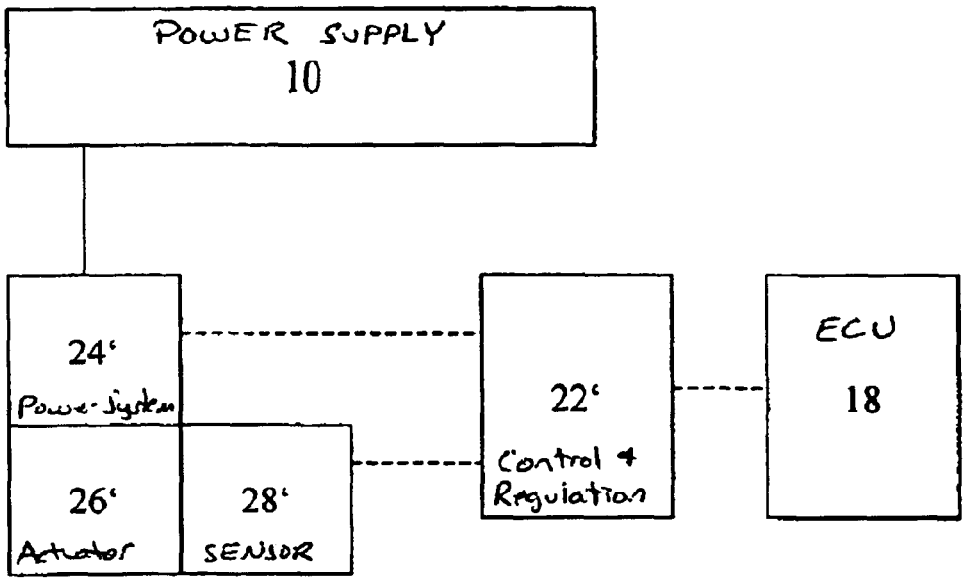
FIG. 3 is a block diagram of a third embodiment of the present invention.

In the embodiment according to FIG. 3, the electronic power system 24', actuator 26' and sensor 28' are illustrated in a combined manner. In this embodiment, the power supply 10 is connected in a conventional manner by means of an electric cable with the electronic power system 24'. However, the electronic power system 24' and the electronic controlling and regulating system 22', as well as the sensor 28' and the electronic controlling and regulating system 22', along with the electronic controlling and regulating system 22' and the engine control 18, are coupled by way of glass fiber connections.

The present combination of an information signal connection implemented by way of glass fiber connections between individual elements of the electromagnetic valve drive, together with conventional power connections by means of electric cables, ensures an information exchange, which is as protected from interferences as possible, between the individual parts and thereby contributes to the operational reliability of the entire electromagnetic valve drive arrangement.

What is claimed is:

1. An electromagnetic valve drive of a charge cycle valve for an internal-combustion engine having electromagnetic valve drive electric devices, wherein said electromagnetic valve drive electric devices include a valve sensor or actuator sensor and a control and regulation device, wherein an information signal connection established between the control and regulation device and one of the valve sensor and actuator sensor uses a glass fiber connection.

2. The electromagnetic valve drive according to claim 1, wherein said electric devices include an engine control, and further wherein a signal connection between the engine control and the control and regulation device uses a glass fiber connection.

3. The electromagnetic valve drive according to claim 1, wherein said electric devices further include an electronic power system, and further wherein a signal connection between the electronic power system and the control and regulation device uses a glass fiber connection.

4. The electromagnetic valve drive according to claim 2, wherein the electric devices further include an electronic power system, and further wherein a signal connection between the electronic power system and the control and regulation device uses a glass fiber connection.

5. The electromagnetic valve drive according to claim 1, wherein the electric devices include an electronic power system, and further wherein the control and regulation device and the electronic power system are combined in a valve control unit.

6. The electromagnetic valve drive according to claim 2, wherein the electric devices further include an electronic power system, and wherein the control and regulation device, together with the electronic power system, are combined in a valve control unit.

7. The electromagnetic valve drive according to claim 3, wherein the control and regulation device, together with the electronic power system, are combined in a valve control unit.

* * * * *